US006394405B1

(12) United States Patent
Roxton et al.

(10) Patent No.: US 6,394,405 B1
(45) Date of Patent: May 28, 2002

(54) CONTINUOUSLY ADJUSTABLE RESCUE STRUT

(75) Inventors: George F. Roxton, Orland Park; Howard Leibovitz, Frankfort, both of IL (US)

(73) Assignee: Para Tech Incorporated, Frankfort, IL (US)

( * ) Notice: Subject to any disclaimer, the term of this patent is extended or adjusted under 35 U.S.C. 154(b) by 0 days.

(21) Appl. No.: 09/352,439

(22) Filed: Jul. 13, 1999

(51) Int. Cl.[7] ..... A47F 5/00
(52) U.S. Cl. ..... 248/354.1; 74/532
(58) Field of Search ..... 248/351, 354.1, 248/354.7, 200.1; 74/532, 527, 89.37

(56) References Cited

U.S. PATENT DOCUMENTS

| | | | | |
|---|---|---|---|---|
| 2,937,984 A | | 5/1960 | Chapellier | |
| 3,797,793 A | * | 3/1974 | Moritz et al. | 248/354.1 |
| 3,815,858 A | * | 6/1974 | Mocny et al. | 248/354.1 |
| 3,904,177 A | | 9/1975 | Dalton | |
| 3,991,964 A | * | 11/1976 | Christopher | 248/354.1 |
| 4,332,512 A | * | 6/1982 | Heintzmann et al. | 248/354.1 |
| 4,375,934 A | * | 3/1983 | Elliot | 248/354.1 |
| 4,662,771 A | | 5/1987 | Roe et al. | |
| 5,215,411 A | * | 6/1993 | Seegmiller | 248/354.1 |
| 5,224,429 A | | 7/1993 | Borgman et al. | |
| 5,282,593 A | | 2/1994 | Fast | |
| 5,593,239 A | | 1/1997 | Sallee | |

FOREIGN PATENT DOCUMENTS

| | | |
|---|---|---|
| BE | 526 057 | 7/1956 |
| FR | 742 164 | 2/1933 |

OTHER PUBLICATIONS

Lockstroke Remote Actuator, Paratech, Inc. Oct. 28, 1994, 4 Pages.

* cited by examiner

*Primary Examiner*—Ramon O. Ramirez
(74) *Attorney, Agent, or Firm*—Jon C. Gealow

(57) ABSTRACT

A strut or strut system continuously adjustable in length for maintaining two bodies in a spaced relationship with respect to each other. Both the length of the strut and the locking of the strut at a desired length may be remotely controlled by pneumatic pressure. The strut system includes a cylindrical outer member having a cylindrical bore for receiving a cylindrical inner member. The cylindrical inner member is provided with a helical groove for engagement with ball bearings which are retained in a helical pattern in a collar attached to the end of the cylindrical outer member which receives the cylindrical inner member. The collar is adjustable between a first position in which the ball bearings are engaged in the helical groove in the cylindrical inner member and a second position in which they are disengaged from the helical groove in the cylindrical member. When the ball bearings are engaged in the helical groove in the cylindrical inner member, the cylindrical inner and outer members may be rotated with respect to each other to adjust the overall length of the strut. Further, the strut will resist a compressing force applied to the opposite ends of the strut. When the collar is in the second position with the ball bearings disengaged from the helical groove in the cylindrical inner member, the cylindrical inner and outer members may be freely reciprocated with respect to each other. Pneumatic pressure may be used to adjust the collar between the two positions, and to extend the cylindrical inner and outer members with respect to each other.

14 Claims, 4 Drawing Sheets

FIG. 7
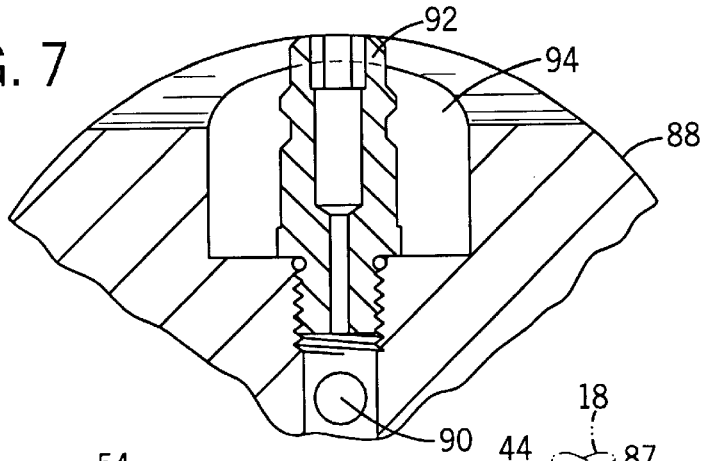
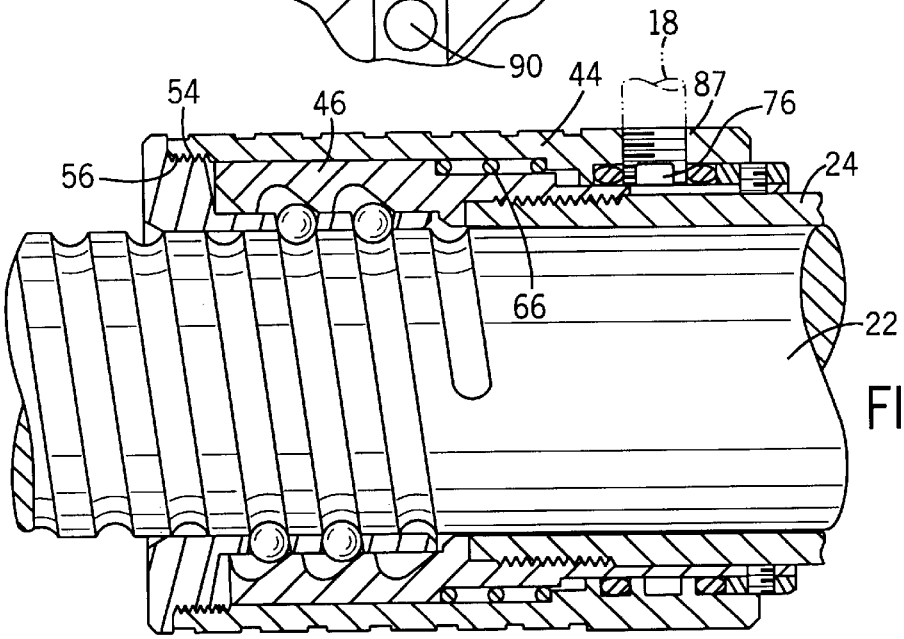
FIG. 8A
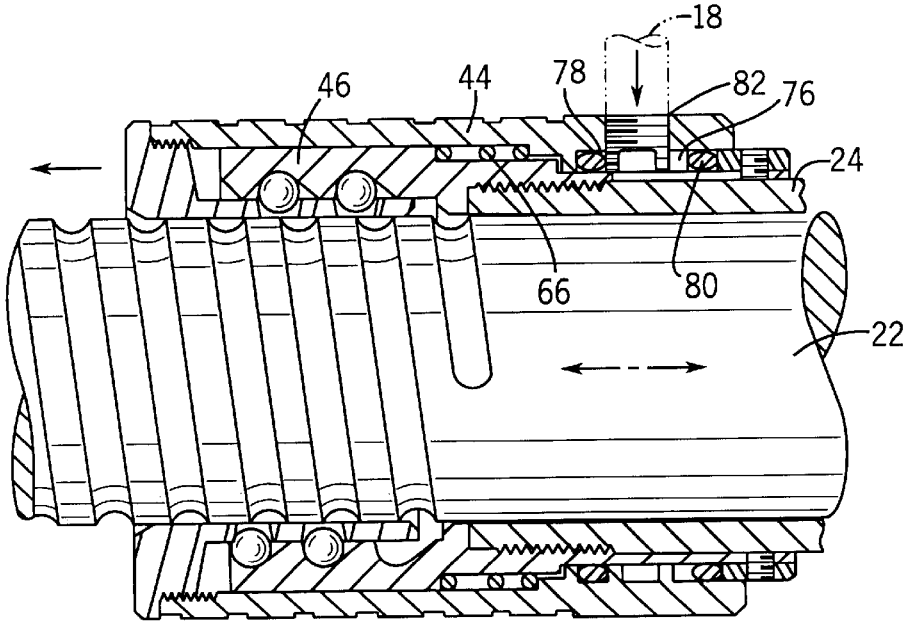
FIG. 8B

CONTINUOUSLY ADJUSTABLE RESCUE STRUT

BACKGROUND OF THE INVENTION

1. Field of the Invention

The present invention relates to a continuously adjustable rescue strut intended to be used as a temporary strut for maintain two objects in a spaced position with respect to each other. More particularly, it relates to a strut of continuously adjustable length intended for use by emergency or rescue personnel to support portions of collapsed building or other structures, such as the wall or a collapsing excavation, in a spaced relationship with respect to each other, so as to permit rescue operations to proceed without the danger of the supported portions moving into a closer position with respect to each other.

2. Description of Related Art Including Information Disclosed Under 37 CFR 1.97 and 37 CFR 1.98

Adjustable length rescue support or strut systems have been provided in the past for use by emergency and rescue personnel for maintaining structures in a spaced relationship with respect to each other. Generally such strut systems are constructed with an inner member being telescopically received in an outer member. The opposite ends of the inner and outer members are each provided with a base suitable for engaging the surface to be supported. A mechanism is provided to maintain the inner and outer members in a desired telescopic relationship with each other, whereby the length of the strut is such that each of the bases engages the surface to be supported. In an elementary form, struts have been formed by inner and outer strut members, each of which is provided with a series of holes perpendicular to and spaced apart along the major axis of each member. The inner and outer members are extended with respect to each other to the desired overall length, and then adjusted with respect to each other to permit a pin to be place in aligned holes in the inner and outer members. A strut of this type is not preferred by rescue personnel, wherein a person must not only place the strut between the surfaces to be supported, but must also adjust the strut to the desired length and then place a pin in aligned holes in the inner and outer members. Thus, the rescue person is exposed to possible shifting of the surfaces to be supported both before and after the strut is in place.

The assignee of the subject application has provided a variety of rescue support or strut systems which are preferred to that just described. The strut systems provided by the assignee of the subject application are designed to be extendable to a desired length, either manually or by remote operation. To provide for remote operation, the inner and outer members are designed to form a cylinder to which pneumatic pressure may be applied to extend the members with respect to each other.

In one of the strut systems provided by the assignee of the subject application, the inner member is provided with a plurality of spaced circumferential notches which receive ball bearings supported in a collar mechanism attached to the outer member. The collar mechanism is movable with respect to the outer member between two positions. With the collar in a first position the inner member is freely movable with respect to the outer member. With the collar in the second position and a compressive or no force applied to the free ends of the strut, the ball bearings are engaged in the notches in the inner member to lock the inner and outer members in position with respect to each other. However, if a force is applied to extend the outer and inner members with respect to each other, the ball bearing are disengaged from the notches in the inner member and the outer and inner members may be extended with respect to each other. The collar is operable between the two positions, either manual or by pneumatic pressure. If a remote handling device is used to place the strut between the surfaces to be supported, the extension and securing in position of the inner and outer members with respect to each other can be accomplished by pneumatic pressure supply through hoses, such that a rescue person need not be endangered by manually positioning the strut system. A limitation on this strut system is that the length is not continuously adjustable. Rather, the length is incrementally adjustable, depending on the spacing of the grooves in the inner member. In a strut system provided by the assignee of this application, the increment is 0.40 inches.

In certain situations, it is most desirable that the strut be adjustable to the exact spacing of the surfaces to be supported, such that even a slight shifting of the surfaces toward each other is not possible with the strut in place. The assignee of this application has provided a strut system which is continuously adjustable in length, and which as in the case of the previously described strut system may be remotely extend by pneumatic pressure. Again, the inner and outer members are designed to form a cylinder to which pneumatic pressure may be applied to extend the members with respect to each other. The outer surface of the inner member is provided with an Acme thread, which is engaged by an Acme threaded nut. After the strut is extended to the desired length, the acme nut is rotated to engage the end of the outer member. While this strut system may be continuously adjusted in length, such that it can be remotely adjusted to the exact spacing of the surfaces to be supported, it does require the manual rotation of the acme nut to secure or lock the inner and outer members in the desired position with respect to each other. Thus, prior to this invention, a strut system providing both continuous extension and locking by remote control has not been available.

SUMMARY OF THE INVENTION

It is an object of this invention to provide a support or strut system which is continuously adjustable in length, for use by emergency and rescue personnel for maintaining structures in a spaced relationship with respect to each other. It is a further object of this invention to provide a support or strut system which is continuously adjustable length and which may be remotely extended in length and locked at the desired length, and remotely unlocked to permit retraction or shortening of the strut.

In accordance with this invention a strut system continuously adjustable in length, and providing both remote extension of the length and locking at the desired length, and remote unlocking to permit retraction or shortening of the strut is provided.

BRIEF DESCRIPTION OF THE DRAWINGS

FIG. 7 is a cross-sectional view of the continuously adjustable strut of this invention taken along the line 7—7 in FIG. 6;

FIG. 8A is a cross-sectional view of second embodiment of the continuously adjustable strut of this invention similar to that of the first embodiment taken along the line 3A—3A in FIG. 2 with components of the strut in a first position;

FIG. 8B is a cross-sectional view of the second embodiment of the continuously adjustable strut of this invention, similar to that of the first embodiment taken along the line 3A—3A in FIG. 2 with components of the strut in a second position;

DESCRIPTION OF THE PREFERRED EMBODIMENTS

Figure 1:
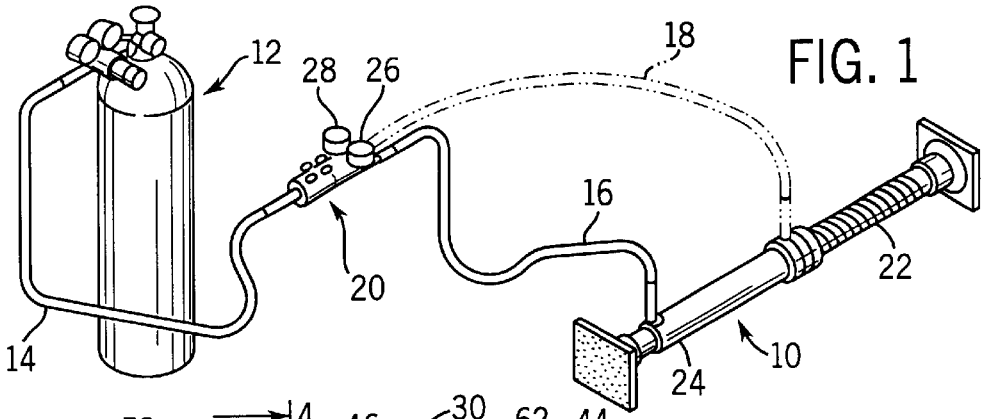
FIG. 1 is a perspective view of one embodiment of an infinitely adjustable strut in accordance with this invention connected to a supply of a compressed gas.

Referring to FIG. 1, an continuously adjustable strut in accordance with a first embodiment of this invention is actuated by pressurized gas. The continuously adjustable strut 10, is connect to a supply of compressed gas, shown as a tank 12, by hoses 14, 16, and 18 through a control valve 20. As will be further explained, the supply of compressed gas through the hose 16 to the continuously adjustable strut 10 will cause an inner cylindrical extensible portion 22 to be extended from an outer cylindrical housing portion 24, and the supply of compressed gas through the hose 18 will release the mechanism which holds the extensible portion 22 and housing portion 24 in an extended support position, such that extensible portion 22 may freely reciprocate with respect to housing portion 24. The control valve 20 is provided with control knobs 26 and 28 to control the supply of compressed gas to hoses 16 and 18 respectively.

Figure 2:
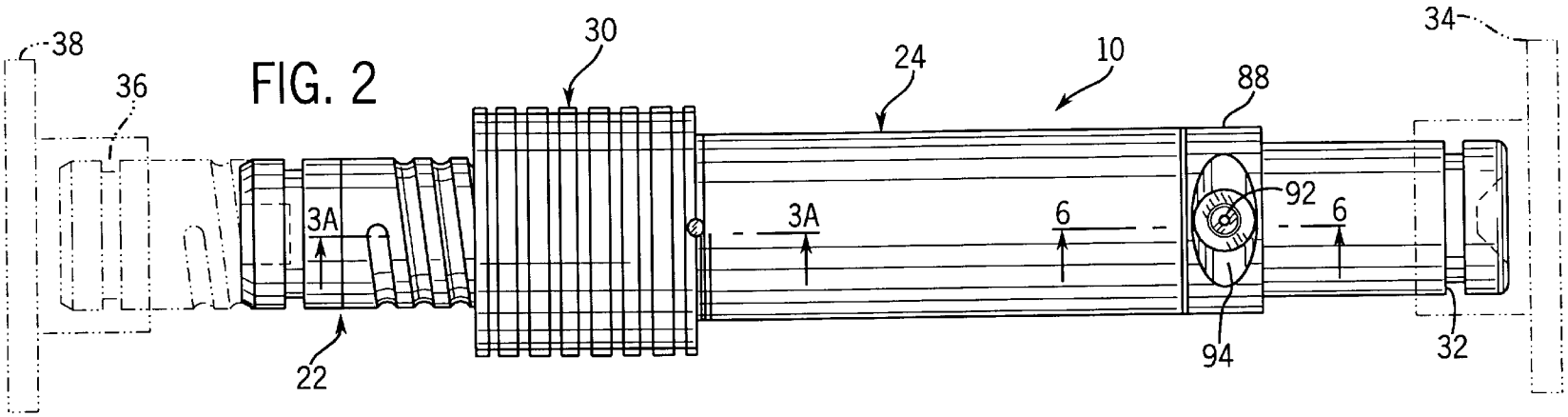
FIG. 2 is a side view of the infinitely adjustable strut of this invention as shown in FIG. 1.

Referring to FIG. 2, a continuously adjustable strut in accordance with the first embodiment of this invention includes outer cylindrical housing portion or tube 24 and inner cylindrical extensible portion or shaft 22. A mechanism for adjustably positioning the outer housing portion 24 and the inner extensible portion 22 with respect to each other is incorporated in a collar 30. The free end of housing portion 24 is provided with an annular groove 32 which may be used to secure a support plate 34, as represented by the dashed lines, to the housing portion 24. Similarly, the free end of the inner extensible portion 22 is provided with an annular groove 36, which may be used to secure a support plate 38, represented by dashed lines, to the inner extensible portion 22.

Figure 3A:
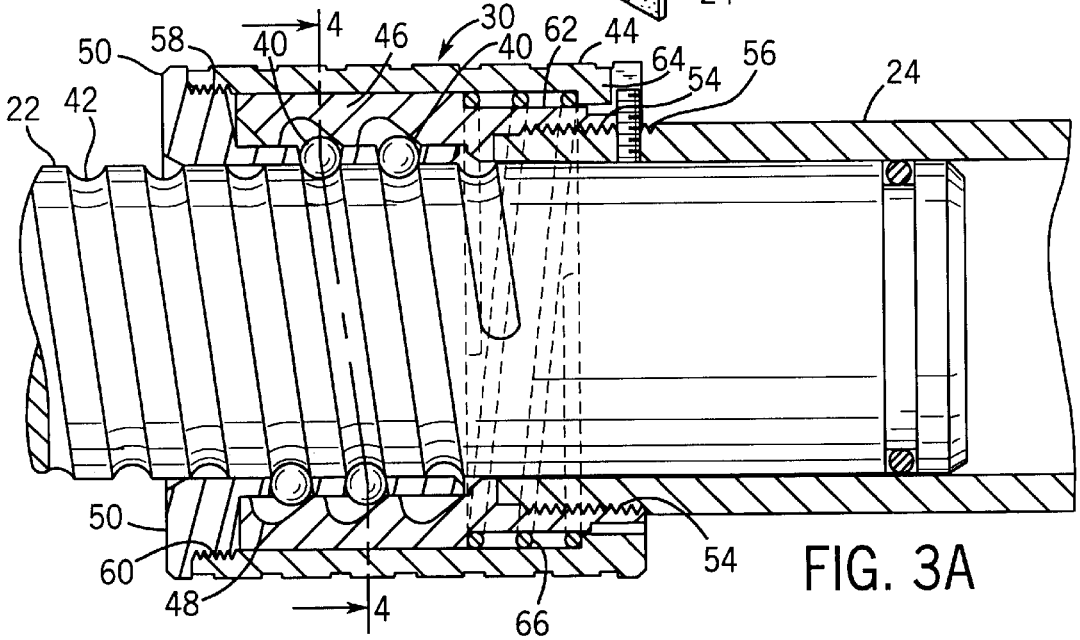
FIG. 3A is a cross-sectional view of a portion of the continuously adjustable strut of this invention taken along the line 3A—3A in FIG. 2 with components of the assembly in a first position.
Figure 3B:
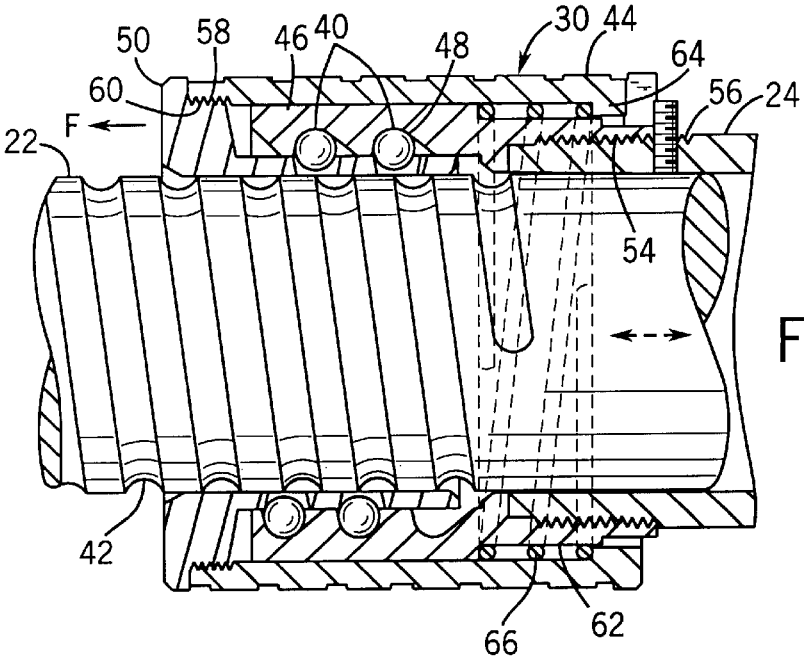
FIG. 3B is a cross-sectional view of the continuously adjustable strut of this invention taken along the 3A—3A in FIG. 2 with components of the strut in a second position.

Reference will now be made to FIGS. 3A and 3B to describe a first embodiment of the mechanism for adjustably positioning the outer housing portion 24 with respect to the inner extensible portion 22. The mechanism supports and retains ball bearings 40 in alternate positions with respect to the collar 30 and the inner extensible portion 22. In a first position, shown in FIG. 3A, the ball bearings are positioned to support the inner extensible portion 22 with respect to the outer housing portion 24, by being engaged in a spiral groove 42 formed in the outer surface of the inner extensible portion 22. In a second position, shown in FIG. 3B, the ball bearings are disengaged from the spiral groove 42 in the inner extensible portion 22, such that the outer housing portion 24 may be freely reciprocated with respect to the inner extensible portion 22.

The collar 30 including three cylindrical members, an outer cylindrical sleeve or release ring 44, and intermediate cylindrical sleeve, or pressure ring housing 46, having a spiral groove 48 formed therein, and an inner cylindrical sleeve, or unlocking ring 50, having holes 52 formed therein for receiving and maintaining the ball bearings 40 in spaced positions with respect to each other. The intermediate sleeve 46 is provided with internal threads 54 at a first end which engage external threads 56 on a first end of outer cylindrical housing portion 24, to maintain the intermediate sleeve 46 in a fixed position with respect to outer cylindrical housing portion 24. Outer cylindrical sleeve 44 is provided with internal threads 58 at a first end which engage external threads 60 on a first end of inner sleeve 50. Outer sleeve 44 and inner sleeve 50, which are secured to each other, may reciprocate with respect to intermediate sleeve 46 and cylindrical housing portion 24, which are secured to each other. Intermediate sleeve 46 is provided with a portion 62 of reduced outer diameter and outer sleeve 44 is provided with a portion 64 of reduce inner diameter to provide a cylindrical space in which a helical spring 66 is captured. As viewed in FIGS. 3A, the helical spring 66 caused the inner sleeve 50 and the outer sleeve 44 to move to the right with respect to the intermediate sleeve 46 and the cylindrical housing portion 24. The application of a force F, as shown in FIG. 3B, sufficient to overcome the force of the spring 66 will cause the outer sleeve 44, and inner sleeve 50 to move to the left with respect to the intermediate sleeve 46 and the cylindrical housing portion 24, as shown in FIG. 3B. This movement of the inner sleeve 50, causes the ball bearings 40 to be moved out of the spiral groove 48 in extensible portion 22 and into the spiral groove 48 in intermediate sleeve 46.

Figure 9:
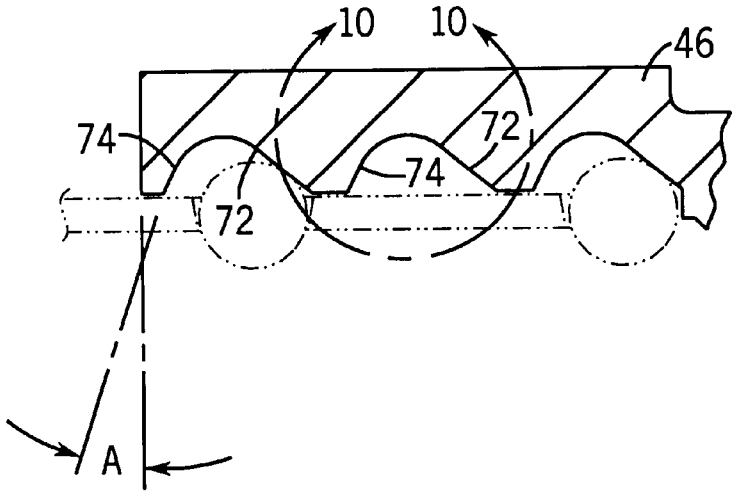
FIG. 9 is an enlarged partial cross-sectional view of a portion of the collar of the continuously adjustable strut of the first embodiment of this invention.
Figure 10:
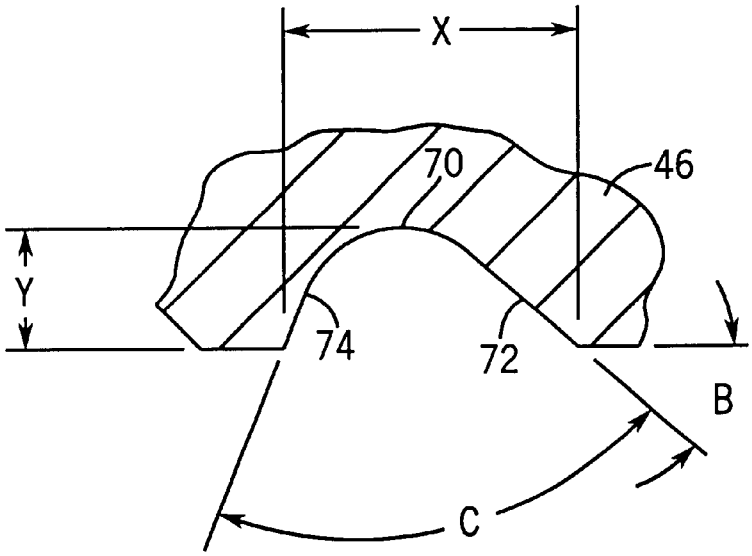
FIG. 10 is an enlarged partial cross-sectional view of the portion of the collar of the continuously adjustable strut of this invention which is encircled by the line 10—10 in FIG. 9.

The holes 52 in inner cylindrical sleeve 50, are formed in a spiral, which in the preferred embodiment makes two revolutions around the sleeve. The holes 52 are formed with a diameter slightly smaller that the diameter of the ball bearings 40, such that the ball bearings are confined by the inner sleeve 50 and internal spiral groove 48, formed in intermediate sleeve 46. The spiral in which the holes 52 are formed in the inner cylindrical sleeve 50, the internal spiral groove 48, and the spiral groove 42 all have the same pitch. The internal spiral groove 48 is formed with a curved base 70 and two sidewalls 72 and 74, which have different slopes as best seen in FIGS. 9 and 10. With the sleeves in the position shown in FIG. 3A, the ball bearings are positioned to be retained in the holes 52, seated in the spiral groove 42 formed in the extensible portion 22, and to engage the sidewall 72 of the spiral groove 48 formed in intermediate sleeve 46. With the sleeves in this position, movement of extensible portion 22 into housing portion 24 is resisted. However, due to the shape of the internal spiral groove 48 formed in intermediate sleeve 46, the extensible portion 22 may be readily extended from housing portion 24, by the application of extensible force. An extensible force tending to move extensible portion 22 out of housing 24 will result in the ball bearings 40 being lifted out of the groove 42 and into engagement with the curved base 70 and sidewall 74 of the spiral groove 46 formed in the intermediate sleeve 46. With the sleeves moved to the position shown in FIG. 3B, by the application of a force F which overcomes the opposing force of the spring 24, the ball bearings 40 are moved out of engagement with the spiral groove 42 in extensible portion 22, and into engagement with the curved base 70 and sidewall 74 of the spiral groove 46 formed in intermediate sleeve 46. With the sleeves in this position, extensible portion 22 may be freely reciprocated with respect to housing portion 24. However, the force F is really only necessary to permit retraction of the strut, wherein as previously set forth, it may be readily extended without the application of a force F.

There are two ways in which the continuously adjustable strut of this invention may be readily adjusted to firmly engage two spaced surfaces, to maintain their spacing. With the sleeves of collar 30 in the position shown in FIG. 3A, the outer housing portion 24 may be rotated with respect to the extensible portion 22, thus causing the strut to be lengthened or shortened depending on the direction of rotation of the portions 22 and 24 with respect to each other. The ball bearings 40 and the spiral groove 42, act as threaded members with respect to each other. The other way to adjust the length is to apply an extensible force between the extensible portion 22 and the housing portion 24.

In one embodiment of this invention, as shown in FIGS. 3A and 3B, the force F may be manually applied between the collar 30 and the housing portion 22, while at the same time manually applying a second force to move extensible portion 22 with respect to housing portion 22.

In another embodiment of this invention, as represented by FIGS. 1, 2, 6, 7, 8A and 8B, the two forces may be applied by a compressed gas. As shown in FIGS. 8A and 8B, an expansible chamber 76 may be formed between the outer sleeve 44 and the intermediate sleeve 46. The ends of the chamber are sealed by resilient sealing rings 78 and 80. A threaded hole 82 is provided in outer sleeve 44 in communication with the chamber 76, to which the hose 18 in FIG. 1 may be secured. By applying a compressed gas to the chamber 76 through the hose 18, the force of spring 66 may be overcome to move the sleeve components to the position shown in FIG. 8B, whereby the extensible portion 22 may be freely reciprocated with respect to the housing portion 24.

Figure 6:
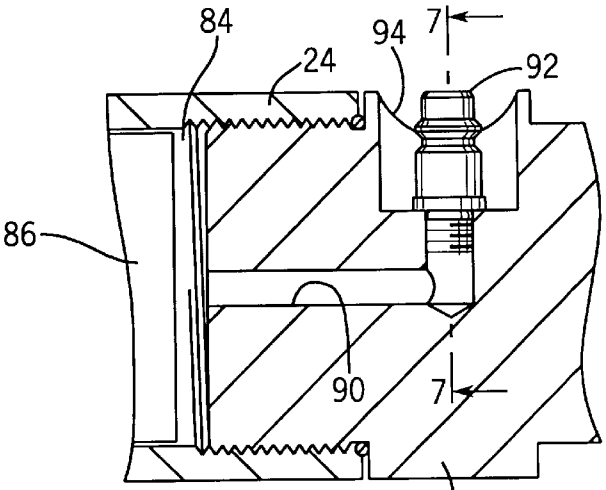
FIG. 6 is a cross-sectional view of the continuously adjustable strut of this invention taken along the line 6—6 in FIG. 2.
Figure 4:
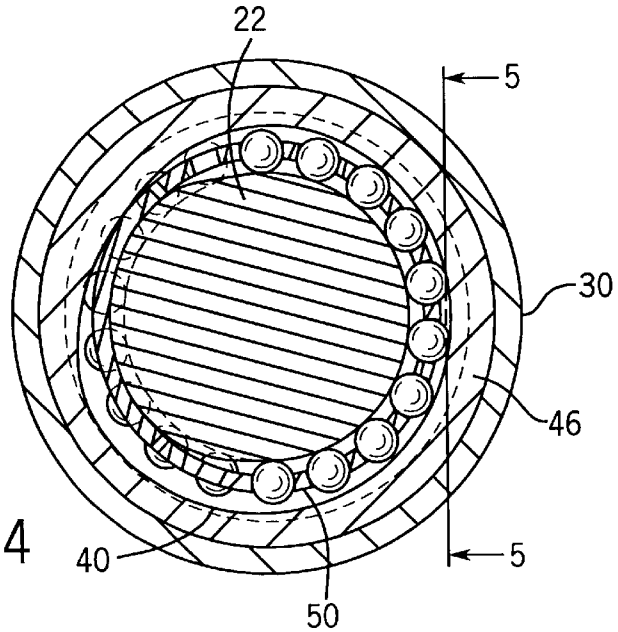
FIG. 4 is a cross-sectional view of the continuously adjustable strut of this invention taken along the line 4—4 in FIG. 3A.
Figure 5:
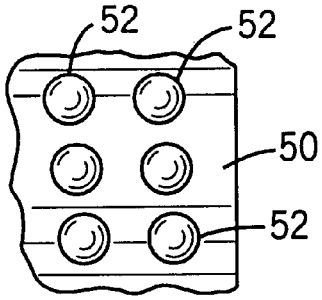
FIG. 5 is a cross-sectional view of the continuously adjustable strut of this invention taken along the line 5—5 in FIG. 4.

As best depicted in FIGS. 2 and 6, a compressed gas cylinder 84 may be formed by the cylindrical housing portion 24, end 86 of extensible portion 22, and a base 88, which is secured by threads to cylindrical housing portion 24. A passageway 90 is formed in base 88 to provide a flow path between the compressed gas cylinder 84 and a fitting 92 to which the hose 16 shown in FIG. 1 may be secured. By applying a compressed gas to the gas cylinder 84, the extensible portion 22 and housing portion 24 may extended with respect to each other. As the strut is being extended, the components of the strut will assume the positions shown in FIG. 8B. After the strut has been extended, the sleeve 46 will move to the position shown in FIG. 8A, whereby the extensible portion 22 and housing portion 24 will be maintained in the position to which they were extended by the compressed gas applied to gas cylinder 84, even after the pressure on gas cylinder 84 is relieved. As shown in FIG. 6, the fitting 92 is positioned in a recess 94 in base 88, thereby protecting it from damage, which otherwise might occur if it projected outward from the base.

Referring again to FIG. 1, the operation of the compressed gas actuated embodiment of the continuously adjustable strut of this invention will be described. After placing the strut 10 between two bodies to be supported with respect to each other, with support plate 34 adjacent one of the bodies and support plate 38 adjacent the other body, control knob 26 is actuated to apply gas pressure through hose 16 to the compressed gas cylinder 84 to extend the extensible portion 22 from the housing portion 24. When the support plates 34 and 38 are in firm engagement with the two bodies, control knob 26 may again be actuated to terminate the application of gas pressure through hose 16. The collar elements are moved to the position shown in FIG. 8A, locking the extensible portion 22 and housing portion 24 in the position to which they were extended by the gas pressure applied to gas cylinder 84. When it is found desirable to permit the strut to retract, control knob 28 is actuated to apply gas pressure through hose 18 to the expansible chamber 76, to position the collar elements in the position shown in FIG. 8B, whereby the extensible portion 22 and housing portion 24 may be freely reciprocated with respect to each other.

In a preferred embodiment of this invention, the strut is provided with 40 ball bearings 11⁄32" in diameter. The threaded groove in the extensible portion has a radius of 0.180" and is 0.103' deep with a pitch of 0.600". Referring to FIGS. 9 and 10, the radius 70 of the bottom of the spiral groove 68 is 0.172", with a depth of 0.195". The angle A of side 74 is 20 degrees, and the angle B of side 72 is 42 degrees. The angle C of the sides 72 and 74 with respect to each other is 68 degrees. The holes in inner sleeve 50 are 0.332" in diameter at the inner surface of the sleeve. The side of the holes sloping outwardly with opposite sides forming an angle of 20 degrees with respect to each other.

While several embodiments of the invention has been shown, and variations described, it should be apparent to those skilled in the art that what have been described are considered at present to be the preferred embodiments of the continuously adjustable strut of this invention. In accordance with the Patent Statute, changes may be made in the continuously adjustable strut of this invention without actually departing from the true spirit and scope of this invention. The appended claims are intended to cover all such changes and modification which fall in the true spirit and scope of this invention.

What is claimed is:

1. An continuously adjustable strut comprising:

an outer housing with first and second ends having a cylindrical bore therein, a cylindrical extensible member with first and second ends, a first end of said cylindrical extensible member received in said cylindrical bore through a first end of said outer housing, a helical groove formed in cylindrical surface of at least a portion of said cylindrical extensible member adjacent said second end, a collar secured to said first end of said outer housing portion, said collar comprising, an outer cylindrical sleeve, an inner cylindrical sleeve, said inner cylindrical sleeve secured to said outer cylindrical sleeve and being provided with a series of holes arranged in a helical pattern, an intermediate cylindrical sleeve, said intermediate cylindrical sleeve being provided with an internal helical groove, said internal helical groove having a curved is base and sides which are asymmetrical with respect to a radius of said intermediate cylindrical sleeve which passes through the center of said curved base, a plurality of ball bearings, said ball bearings being retained between said inner cylindrical sleeve and said intermediate cylindrical sleeve in said Internal helical groove and said series of holes, a spring for applying a force between said outer sleeve and said intermediate sleeve to hold said outer sleeve and said intermediate sleeve in a first position with respect to each other, in said first position, said ball bearings are engaged in said groove in said cylindrical extensible member, such that rotation of said outer sleeve with respect to said cylindrical extensible member will result in adjustment of the position said outer housing with respect to said cylindrical extensible member, in said first position, said outer housing portion and said cylindrical extensible member resisting a compressive force applied between the second end of the outer housing and the second end of the cylindrical extensible member, and when a force is applied between said outer cylindrical sleeve and said intermediate cylindrical sleeve, to overcome the force of said spring, said outer cylindrical sleeve and said intermediate cylindrical sleeve are moved to a second position in which said ball bearings are disengaged from said groove in said cylindrical extensible member and said outer housing and said cylindrical extensible member may be reciprocated with respect to each other.

2. The continuously adjustable strut of claim 1, wherein said intermediate sleeve is secured to the end of said outer housing and said inner cylindrical sleeve and said outer cylindrical sleeves are secured to each other, such that a force opposing the force of said helical spring applied between said outer cylindrical sleeve and said outer housing portion will cause said helical spring to be compressed, thereby disengaging said balls from said groove in said cylindrical extensible portion, such that said outer housing portion and said cylindrical extensible portion may be reciprocated with respect to each other.

3. The continuously adjustable strut of claim 1, wherein said inner cylindrical sleeve is provided with external threads and said outer cylindrical sleeve is provided with internal threads, which threads are engaged with each other to secure the inner and outer sleeves to each other.

4. The continuously adjustable strut of claim 1, wherein said intermediate cylindrical sleeve is provided with internal threads and said outer housing is provided with external threads which are engaged with each other to secure the intermediate cylindrical sleeve to the outer housing.

5. The continuously adjustable strut of claim 1, wherein said outer and said intermediate cylindrical sleeve members form a cylindrical chamber, and said helical spring is captured in said cylindrical chamber between said outer and said intermediate cylindrical sleeve member.

6. The continuously adjustable strut of claim 1, wherein said outer and said intermediate cylindrical sleeve members form a first expansible chamber, such that the application of pneumatic pressure to said first expansible chamber will result in a pneumatic force which will overcome the force of said spring, such that said outer cylindrical sleeve and said intermediate cylindrical sleeve are moved to a second position in which said ball bearings are disengaged from said groove in said cylindrical extensible member and said outer housing and said cylindrical extensible member may be reciprocated with respect the each other.

7. The continuously adjustable strut of claim 1, wherein a second expansible chamber is formed between said second end of said outer housing and the first end of said cylindrical extensible member, such that the application of pneumatic pressure to the second expansible chamber will cause the cylindrical extensible member to be extended from said outer housing.

8. The continuously adjustable strut of claim 7, wherein a recess is provided in the second end of said outer housing for receiving a fitting for connecting a source of pneumatic pressure to the second expansible chamber.

9. An continuously adjustable strut comprising:

an outer housing with first and second ends having a cylindrical bore therein, a cylindrical extensible member with first and second ends, a first end of said cylindrical extensible member received in said cylindrical bore through a first end of said outer housing, a helical groove formed in cylindrical surface of at least a portion of said cylindrical extensible member adjacent said second end.

a collar secured to said first end of said outer housing portion, said collar comprising, an outer cylindrical sleeve, an inner cylindrical sleeve, said inner cylindrical sleeve secured to said outer cylindrical sleeve and being provided with a series of holes arranged in a helical pattern, an intermediate cylindrical sleeve, said intermediate cylindrical sleeve being provided with an internal helical groove, said internal helical groove formed in said intermediate cylindrical sleeve having an arcuate base and straight sides, the straight sides being at different angles with respect to the internal surface of said intermediate cylindrical sleeve, a plurality of ball bearings, said ball bearings being retained between said inner cylindrical sleeve and said intermediate cylindrical sleeve in said internal helical groove and said series of holes, a spring for applying a force between said outer sleeve and said intermediate sleeve to hold said outer sleeve and said intermediate sleeve in a first position with respect to each other, in said first position, said ball bearings are engaged in said groove in said cylindrical extensible member, such that rotation of said outer sleeve with respect to said cylindrical extensible member will result in adjustment of the position said outer housing with respect to said cylindrical extensible member, in said first position, said outer housing portion and said cylindrical extensible member resisting a compressive force applied between the second end of the outer housing and the second end of the cylindrical extensible member, and when a force is applied between said outer cylindrical sleeve and said intermediate cylindrical sleeve, to overcome the force of said spring, said outer cylindrical sleeve and said intermediate cylindrical sleeve are moved to a second position in which said ball bearings are disengaged from said groove in said cylindrical extensible member and said outer housing and said cylindrical extensible member may be reciprocated with respect to each other.

10. An continuously adjustable strut comprising:

an outer housing with first and second ends having a cylindrical bore therein, a cylindrical extensible member with first and second ends, a first end of said cylindrical extensible member received in said cylindrical bore through a first end of said outer housing, a helical groove formed in cylindrical surface of at least a portion of said cylindrical extensible member adjacent said second end, a collar secured to said first end of said outer housing portion, said collar comprising, an outer cylindrical sleeve, an inner cylindrical sleeve, said inner cylindrical sleeve secured to said outer cylindrical sleeve and being provided with a series of holes arranged in a helical pattern, an intermediate cylindrical sleeve, said intermediate cylindrical sleeve being provided with an internal helical groove, said internal helical groove formed in said intermediate cylindrical sleeve having an arcuate base and straight sides, the side of the groove facing the first end of the outer housing being at a greater angle to the internal surface of said intermediate cylindrical sleeve than the side of the groove facing the second end of the outer housing, a plurality of ball bearings, said ball bearings being retained between said inner cylindrical sleeve and said intermediate cylindrical sleeve in said internal helical groove and said series of holes, a spring for applying a force between said outer sleeve and said intermediate sleeve to hold said outer sleeve and said intermediate sleeve in a first position with respect to each other, in said first position, said ball bearings are engaged in said groove in said cylindrical extensible member, such that rotation of said outer sleeve with respect to said cylindrical extensible member will result in adjustment of the position said outer housing with respect to said cylindrical extensible member, in said first position, said outer housing portion and said cylindrical extensible member resisting a compressive force applied between the second end of the outer housing and the second end of the cylindrical extensible member, and when a force is applied between said outer cylindrical sleeve and said intermediate cylindrical sleeve, to overcome the force of said spring, said outer cylindrical sleeve and said intermediate cylindrical sleeve are moved to a second position in which said ball bearings are disengaged from said groove in said cylindrical extensible member and said outer housing and said cylindrical extensible member may be reciprocated with respect to each other.

11. The continuously adjustable strut of claim 10, wherein with said intermediate sleeve in said first position, said ball bearings are engaged in said groove in said cylindrical extensible member, and also engage the side of the groove in said intermediate sleeve facing the second end of said outer housing.

12. An continuously adjustable strut comprising:

an outer housing with first and second ends having a cylindrical bore therein, a cylindrical extensible member with first and second ends, a first end of said cylindrical extensible member received in said cylindrical bore through a first end of said outer housing, a helical groove formed in cylindrical surface of at least a portion of said cylindrical extensible member adjacent said second end, a collar secured to said first end of said outer housing portion, said collar comprising, an outer cylindrical sleeve, an inner cylindrical sleeve, said inner cylindrical sleeve secured to said outer cylindrical sleeve and being provided with a series of holes arranged in a helical pattern, an intermediate cylindrical sleeve, said intermediate cylindrical sleeve being provided with an internal helical groove, said internal helical groove formed in said intermediate cylindrical sleeve having an arcuate base having a radius essentially the same as that of said ball bearing, and straight sides, the side of the groove facing the first end of the outer housing being at an angle of approximately 70 degrees to the internal surface of said intermediate cylindrical sleeve and the side of the groove facing the second end of the outer housing being at an angle of approximately 42 degrees to the internal surface of said intermediate cylindrical sleeve, a plurality of ball bearings, said ball bearings being retained between said inner cylindrical sleeve and said intermediate cylindrical sleeve in said internal helical groove and said series of holes, a spring for applying a force between said outer sleeve and said intermediate sleeve to hold said outer sleeve and said intermediate sleeve in a first position with respect to each other, in said first position, said ball bearings are engaged in said groove in said cylindrical extensible member, such that rotation of said outer sleeve with respect to said cylindrical extensible member will result in adjustment of the position said outer housing with respect to said cylindrical extensible member, in said first position, said outer housing portion and said cylindrical extensible member resisting a compressive force applied between the second end of the outer housing and the second end of the cylindrical extensible member, and when a force is applied between said outer cylindrical sleeve and said intermediate cylindrical sleeve, to overcome the force of said spring, said outer cylindrical sleeve and said intermediate cylindrical sleeve are moved to a second position in which said ball bearings are disengaged from said groove in said cylindrical extensible member and said outer housing and said cylindrical extensible member may be reciprocated with respect to each other.

13. An continuously adjustable strut comprising:

an outer housing with first and second ends having a cylindrical bore therein, a cylindrical extensible member with first and second ends, a first end of said cylindrical extensible member received in said cylindrical bore through a first end of said outer housing, a helical groove formed in cylindrical surface of at least a portion of said cylindrical extensible member adjacent said second end, a collar secured to said first end of said outer housing portion, said collar comprising, an outer cylindrical sleeve, an inner cylindrical sleeve, said inner cylindrical sleeve secured to said outer cylindrical sleeve and being provided with a series of holes arranged in a helical pattern, said series of holes in said inner cylindrical sleeve being tapered, having a smaller diameter at the inner surface of said inner cylindrical sleeve than at the outer surface of said inner cylindrical sleeve, an intermediate cylindrical sleeve, said intermediate cylindrical sleeve being provided with an internal helical groove, a plurality of ball bearings, said ball bearings being retained between said inner cylindrical sleeve and said intermediate cylindrical sleeve in said internal helical groove and said series of holes, a spring for applying a force between said outer sleeve and said intermediate sleeve to hold said outer sleeve and said intermediate sleeve in a first position with respect to each other, in said first position, said ball bearings are engaged in said groove in said cylindrical extensible member, such that rotation of said outer sleeve with respect to said cylindrical extensible member will result in adjustment of the position said outer housing with respect to said cylindrical extensible member, in said first position, said outer housing portion and said cylindrical extensible member resisting a compressive force applied between the second end of the outer housing and the second end of the cylindrical extensible member, and when a force is applied between said outer cylindrical sleeve and said intermediate cylindrical sleeve, to overcome the force of said spring, said outer cylindrical sleeve and said intermediate cylindrical sleeve are moved to a second position in which said ball bearings are disengaged from said groove in said cylindrical extensible member and said outer housing and said cylindrical extensible member may be reciprocated with respect to each other.

14. The continuously adjustable strut of claim 13, wherein the diameter of said series of holes at the inner surface of said inner cylindrical sleeve is small than the diameter of said ball bearings.

* * * * *